US009764877B2

(12) United States Patent
Tanaka

(10) Patent No.: US 9,764,877 B2
(45) Date of Patent: Sep. 19, 2017

(54) CAPPED CONTAINER

(71) Applicant: Treasure Inc., Tokyo (JP)

(72) Inventor: Mikio Tanaka, Tokyo (JP)

(73) Assignee: TR HOLDINGS INC. (JP)

( * ) Notice: Subject to any disclaimer, the term of this patent is extended or adjusted under 35 U.S.C. 154(b) by 0 days.

(21) Appl. No.: 14/899,084

(22) PCT Filed: Jun. 2, 2014

(86) PCT No.: PCT/JP2014/002912

§ 371 (c)(1),
(2) Date: Dec. 16, 2015

(87) PCT Pub. No.: WO2015/186153

PCT Pub. Date: Dec. 10, 2015

(65) Prior Publication Data

US 2017/0073121 A1 Mar. 16, 2017

(51) Int. Cl.
*B65D 41/04* (2006.01)

(52) U.S. Cl.
CPC ..... *B65D 41/0414* (2013.01); *B65D 41/0471* (2013.01)

(58) Field of Classification Search
CPC ..... B65D 41/0471; B65D 51/1688; B65D 41/0421; B65D 1/0246; B65D 41/3409; B65D 2251/023
USPC ..... 215/330
See application file for complete search history.

(56) References Cited

U.S. PATENT DOCUMENTS 5,845,798 A 12/1998 Carrier
6,227,391 B1 5/2001 King
2005/0082249 A1 4/2005 King

FOREIGN PATENT DOCUMENTS

| | | | |
|---|---|---|---|
| JP | S63-107946 | U | 7/1988 |
| JP | 169463/1988 | | 7/1990 |
| JP | 105877/1989 | | 4/1991 |
| JP | H10-258856 | A | 9/1998 |
| JP | 2000-109104 | A | 4/2000 |
| JP | 2003-012017 | A | 1/2003 |
| JP | 2003-267408 | A | 9/2003 |

(Continued)

OTHER PUBLICATIONS

English abstract for JP2005-206163.

(Continued)

*Primary Examiner* — Shawn M Braden
(74) *Attorney, Agent, or Firm* — Fishman Stewart PLLC

(57) ABSTRACT

A capped container is provided, which maintains, by a simple fastening structure, like a conventional one, sufficient sealability inside and prevents contents from leaking outside an opening of a container body when opening while fastening a cap and a container, and also prevents the leakage, even when an expected large force is applied to the cap in an opening direction. Included are the container body with outer screws on an outer peripheral surface of a head section, and the cap with inner screws threadedly engaged therewith on an inner peripheral surface, placed on and removed from the head section of the container body by screw-fitting. Provided are a first fastening means by clickstop including a cap-side annular projection interengaged with the cap on the container body, and a second fastening means by clickstop including pluralities of container body- and cap-side projections on the container body and in the cap, respectively.

6 Claims, 7 Drawing Sheets

(56) References Cited

FOREIGN PATENT DOCUMENTS

| | | | |
|---|---|---|---|
| JP | 2005-206163 | A | 8/2005 |
| JP | 2011-189970 | A | 9/2011 |
| JP | 2014-000997 | A | 1/2014 |
| WO | WO-2010-035408 | A1 | 4/2010 |

OTHER PUBLICATIONS

English abstract for JP2011-189970.
English abstract for JP2003-012017.
English abstract for JP2000-109104.
English abstract for JP2014-000997.

CAPPED CONTAINER

CROSS-REFERENCE TO RELATED APPLICATION

This application claims priority to and is a US national stage application of PCT/JP2014/002912 filed on Jun. 2, 2014, which is incorporated herein by reference in its entirety.

TECHNICAL FIELD

The present invention relates to a capped container with a cap that closes an opening formed at a head section of a container body.

BACKGROUND ART

In the related art, as a container which contents can be easily stored in and taken out from, there has been widely used a capped container with a cap that closes an opening that has been formed at a head section of a container body. In many cases, a capped container includes fixing means for a container body and a cap such that the cap can be easily opened and closed, while preventing contents that have been stored in the container body from leaking outside during storage or transportation when the cap is closed. In particular, for contents that are likely to scatter, such as liquids, a reliable fastening means is required, and a method using screws, for example, is generally known.

In a case where a container and a cap are fastened using screws, screw positions of a screw that has been provided outside an opening of the container and an inner screw to be threadedly engaged with the outside screw are adjusted inside the cap, and either the container or the cap is rotated in a certain direction. Then, screw threads are guided by screw grooves to move in a circumferential direction. As a result, the cap and the container are fastened while moving in an axial direction. In order to maintain airtightness inside the container, the inside of the container is generally separated from outside and sealed by arranging a packing material in part of a contact part of the two members and threadedly engaging the cap with the container body (not illustrated).

However, in a case where a cap is fastened only with a fastening structure by screws, when vibration or the like is applied to a container after fastening, friction resistance of the screws decreases by the vibration, and the fastening structure of the container and the cap loosens, which results in deterioration of sealing performance thereof, and in some cases, a risk that the cap may come off.

Therefore, in order to increase loosening and friction of the screws, known is a structure that increases friction force by fastening the screws, prevents loosening of the screws, and improves adhesive performance by arranging a plurality of screw threads with different lead angles (Patent Literature 1). Another structure known has, in addition to the fastening means by screws, a means for locking and firmly attaching a container by entrance and adherence of a projection shape annular projection of the container into a recess section provided on an edge side of the cap, or by either projection section's climbing over the other, due to elastic deformation caused by a certain pressure in an axial direction in either a cap section or a container body, or both thereof. There have been proposed capped containers with a locking means by projections in addition to the screw means, such as those with a mechanism that prevents a screw from returning at a terminal end of the screw by installing a projection shape locking tool at a terminal end of a screwing section (Patent Literature 4), those that include an annular projection at a terminal end of a screwing section and prevent the screw from loosening due to easy return thereof, by climbing over the annular projection by an annular projection in a cap section by screwing the cap (Patent Literatures 2 and 3), and those that can, as a result of this, prevent loosening of the cap as well as occurrence of a backlash (Patent Literature 5). However, for example, in a case where the contents are liquids, or in a case where a specific gravity thereof is large, there is a problem that the contents overflow when opening by being blown up near the cap by, for example, vibrations applied from outside.

As a means for preventing such leakage, it may be acceptable to include a method using a double cap or a means such as installing inside the cap an inner ring, the diameter of which is smaller than that of a container body. However, in a case where a double cap is used, overflow of the contents can be prevented, whereas, in a work requiring quick movement in an experiment, for example, removing, after opening a cap, another cap is a complicated work. Even in a method using an inner ring, a gap often generates between the container and the inner ring, which may deteriorate adhesive performance.

Then, the applicant has proposed a capped container, by which sealing performance inside the container is sufficiently maintained, while fastening a cap and the container by a simple fastening structure (JP 2014-997).

The capped container the applicant has proposed includes, as illustrated in FIGS. 1(*a*) and 1(*b*), a container body 1 and a cap 2. The container body has outer screws 12 formed on an outer peripheral surface 111 of a head section 11. The cap has inner screws 22 to be threadedly engaged with the outer screws 12, formed on an inner peripheral surface 21, and is placed on the head section 11 of the container body 1 by screw-fitting and removed therefrom. An opening end 112 in the head section 11 of the container body 1 closely contacts a top inner surface 24 of the cap 2, when the cap 2 is placed on the head section 11 of the container body 1. A so-called clickstop mechanism is provided, where, for the container body, a container body-side annular projection 13 is projected toward a top section rather than in a terminal end section of the outer screws 12 on the outer peripheral surface 111 of the head section 11, and on a top section side rather than in a terminal end of a top section side of the inner screws 22 on the inner peripheral surface of the cap 2, a cap-side annular projection 23 is included, which can be climbed over by the container body-side annular projection 13 and is interengaged therewith at the climbing-over position at the time of threaded engagement with and placement on the head section 11 of the container body 1. By including the fastening means by screws and annular projections, the cap can be reliably fastened to the container body by one click. Compared with a conventional capped container, not only sealing performance is superior, but also opening and closing operation of the cap is simple due to one-click operability. Like a container used for temporarily storing collected samples (such as tumor, blood, and tissue), in fields such as medical and research, it is, due to the nature, required to prevent contamination with bacteria, chemical substances, and the like from outside, or prevent, for example, biological hazards caused by scatter of collected samples to the outside. Therefore, high sealing performance is required, while in terms of test operability it is most appropriate to use as a container with a cap easy to open and close, for example.

However, in the capped container the applicant has proposed, there is a possibility that the cap comes off at least when a force that causes a cap-side annular projection to climb over a container body-side annular projection is applied, in a case, for example, where containers, supporting members, and the like adjacently arranged fly in a vertical direction, collide with lower end surfaces of the caps placed on the container bodies, and receive an unexpectedly large impact in a direction of the top section of the cap, in a case, for example, where a plurality of capped containers is packaged in an erected state and transported under an enormous specific gravity during transportation by airplane, for example. In order to prevent this sort of problem, it is possible to strengthen engagement between the cap-side annular projection and the container body-side annular projection, that is, to make height higher and increase force to climb over, but there is a problem that opening and closing operation becomes difficult, thereby losing convenience.

CITATION LIST

Patent Literatures

Patent Literature 1: PCT/JP/2009/004276
Patent Literature 2: JP 2000-109104 A
Patent Literature 3: JP S63-107946 Y
Patent Literature 4: JP 2003-12017 A
Patent Literature 5: JP 2014-997 A

SUMMARY OF INVENTION

Technical Problem

An object of the present invention is to provide a capped container that, as with the capped container in the related art, not only maintains sufficient sealing performance inside the container, while fastening the cap and the container by a simple fastening structure, and prevents contents from leaking outside an opening section of the container body even at the time of opening, but also maintains the fastening of the cap and a container body and prevents the leakage of the contents, even when an expected large force is applied to the cap in an opening direction.

Solution to Problem

The present invention proposed in order to solve the problem is a capped container including a container body that has outer screws formed on an outer peripheral surface in a head section, and a cap that has inner screws to be threadedly engaged with the outer screws, formed on an inner peripheral surface, and is placed on the head section of the container body by screw-fitting and removed therefrom, wherein an opening end in the head section of the container body closely contacts a top inner surface of the cap when the cap is placed on the head section of the container body, the inner screws formed on the inner peripheral surface of the cap are inward multiple thread screws arranged at predetermined distance and angle, the outer screws to be threadedly engaged with the inner screws, formed on the outer peripheral surface of the head section of the container body, are formed by upper and lower two-stage outward multiple thread screws arranged at a predetermined distance and angle in accordance with the inward multiple thread screws, a pair of inward multiple thread screws, formed adjacent to each other on the inner peripheral surface of the cap when the cap is placed on the head section of the container body, is threadedly engaged, at a clamping position, with the upper and lower outward multiple thread screws formed on the outer peripheral surface of the head section of the container body, and guided to a first fitting position, the inward multiple thread screws, which have been formed on the inner peripheral surface of the cap and closely clamp the upper and lower outward multiple thread screws formed on the outer peripheral surface of the head section of the container body when additionally screwing and fastening the cap, climb over the lower outward multiple thread screws and are guided to a second fitting position closely clamped between the upper and lower outward multiple thread screws that have been clamped, a first fastening means achieving a clickstop is provided, including a container body-side annular projection that is projected toward a top section rather than in a terminal end section of the outer screws on the outer peripheral surface of the head section of the container body, and a cap-side annular projection, which is projected toward a top section rather than in a terminal end of a top section side of the inner screws formed on the inner peripheral surface of the cap, can be climbed over by the container body-side annular projection, and is interengaged therewith at the first fitting position of the container body, when threadedly engaged with and placed on the head section of the container body at the first fitting position, and a second fastening means achieving a clickstop is provided, including a plurality of container body-side projections that are projected radially each other through a predetermined gap section toward a bottom section rather than in the terminal end section of the lower outward screws on the outer peripheral surface of the head section of the container body, and at a length within the range of the cap when the cap is placed, and a plurality of cap-side projections, top surfaces of which are arranged, through a gap section of the container body-side projections, toward bottoms rather than on bottom surfaces of the container body-side projections projected on the outer peripheral surface of the head section when the cap is placed at the first fitting position on an inner peripheral surface of an opening end of the cap, and are pressed and held overlapping each other on the bottom surfaces of the container body-side projections, when the cap is fastened, and threadedly engaged and placed at the second fitting position.

In an embodiment of the present invention, it is preferable that an inner ring, which abuts on an inside surface along an opening end of the head section of the container body when the cap is placed on the head section of the container body, and clamps and supports a vicinity of the opening end section thereof between itself and the inside surface of the cap, be formed on the top inner surface of the cap, and that a flange, which has an outer shape along an edge of the opening end of the placed cap, be projected toward the bottom surface of the container body-side projections on an outer periphery of the container body.

Advantageous Effects of Invention

According to an embodiment of the present invention, not only a cap can be quickly opened and closed with less rotation by using multiple thread screws as a screw mechanism, but also opening and closing operation can be reliably executed particularly because a user is provided with a double click feeling through a configuration where multiple thread screws on a container body side are arranged in two tiers and fitted into multiple thread screws on a cap side in two stages. In particular, first and second fastening means different from the screw mechanism are included. The first fastening means includes a container body-side annular projection that is projected toward a top section rather than in a terminal end section of outer screws formed on an outer peripheral surface of a head section of the container body, and a cap-side annular projection that is projected toward a top section rather than in a terminal end of the top section side of inner screws formed on an inner peripheral surface of the cap, can be climbed over by the container body-side annular projection, and is interengaged therewith at the first fitting position of the container body, when threadedly engaged with and placed on the head section of the container body at the first fitting position. The second fastening means includes a plurality of container body-side projections that are projected radially each other through a predetermined gap section toward a bottom section rather than in a terminal end section of the lower outward screws on the outer peripheral surface of the head section of the container body, and at a length within the range of the cap when the cap is placed, and a plurality of cap-side projections, top surfaces of which are arranged toward a bottom rather than on bottom surfaces of the container body-side projections projected on the outer peripheral surface of the head section, through the gap section of the container body-side projections, when the cap is placed at the first fitting position on the inner peripheral surface of an opening end of the cap, and are pressed and held overlapping each other on the bottom surfaces of the container body-side projections, when the cap is threadedly engaged with and placed on the head section of the container body at the second fitting position through the gap section. Therefore, each time when the two-stage fitting states are formed, in addition to the mechanism where screws are fastened in two stages, the first and second fastening means together keep the cap at a closing position and thus, can reliably prevent leakage of the contents without coming off of the cap due to, for example, vibrations during storage and transportations.

DESCRIPTION OF EMBODIMENTS

A preferred embodiment of the present invention will be described below in detail.

Figure 1:
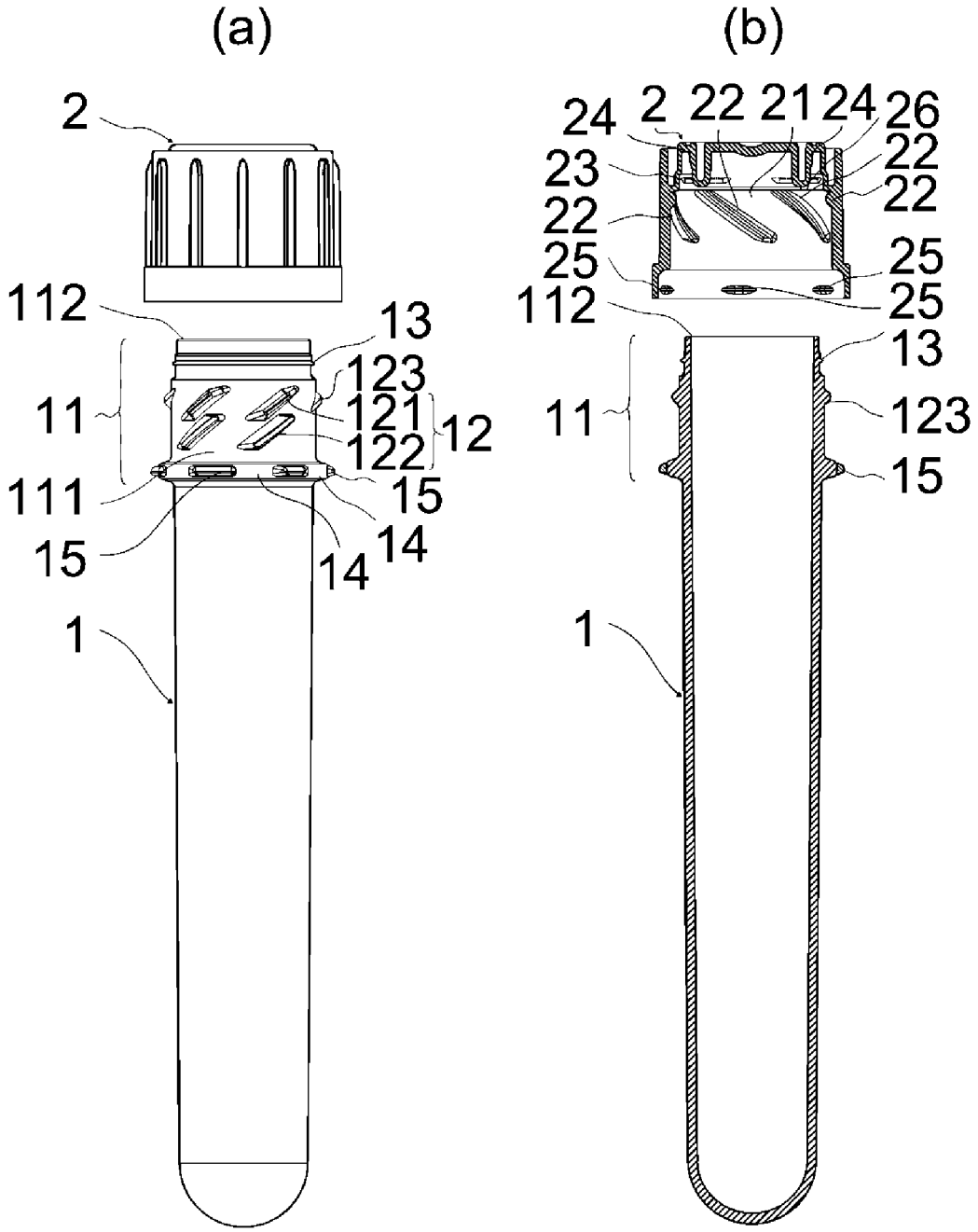
FIGS. 1(*a*) and 1(*b*) are front and sectional views of a preferred embodiment of the present invention.

FIGS. 1(*a*) and 1(*b*) illustrate the preferred embodiment of the present invention. A basic configuration includes, as with a capped container in the related art, a container body 1 which has a bottom, a top surface opened, and outer screws 12 formed on an outer peripheral surface 111 of a head section 11, and a cap 2 which has inner screws 22 to be threadedly engaged with the outer screws 12, screwed and fastened on an inner peripheral surface 21, and is placed and removed by screw-fitting, wherein an opening end 112 of the head section 11 of the container body 1 closely contacts a top inner surface 24 of the cap 2, when the cap 2 is placed on the head section 11 of the container body 1.

The inner screws 22 formed on the inner peripheral surface 21 of the cap 2 are inward multiple thread screws 221 . . . 221 arranged at predetermined distance and angle with six arranged at equal distances, for example. The outer screws 12 to be threadedly engaged with the inner screws 22, formed on the outer peripheral surface 111 in the head section 11 of the container body 1, are arranged in accordance with the inward multiple thread screws 221 radiated at an angle of 60° around a central axis by upper and lower two-stage outward multiple thread screws 121 and 122 in pairs, which are installed at a distance in accordance with the width of the inward multiple thread screws 221 and at the same angle as the inward multiple thread screws 221 in the container body 1, and within the arrangement distance of the inward multiple thread screws 221 . . . 221 in the container body 1. A pair of inward multiple thread screws 221, formed adjacent to each other on the inner peripheral surface 21 of the cap 2 when the cap is placed on the head section 11 of the container body 1, is threadedly engaged, at a clamping position, with the pair of upper and lower outward multiple thread screws 121 and 122 formed on the outer peripheral surface 111 of the head section 11 of the container body 1, and guided to a first fitting position (state illustrated in FIG. 2(*a*)).

Figure 2:
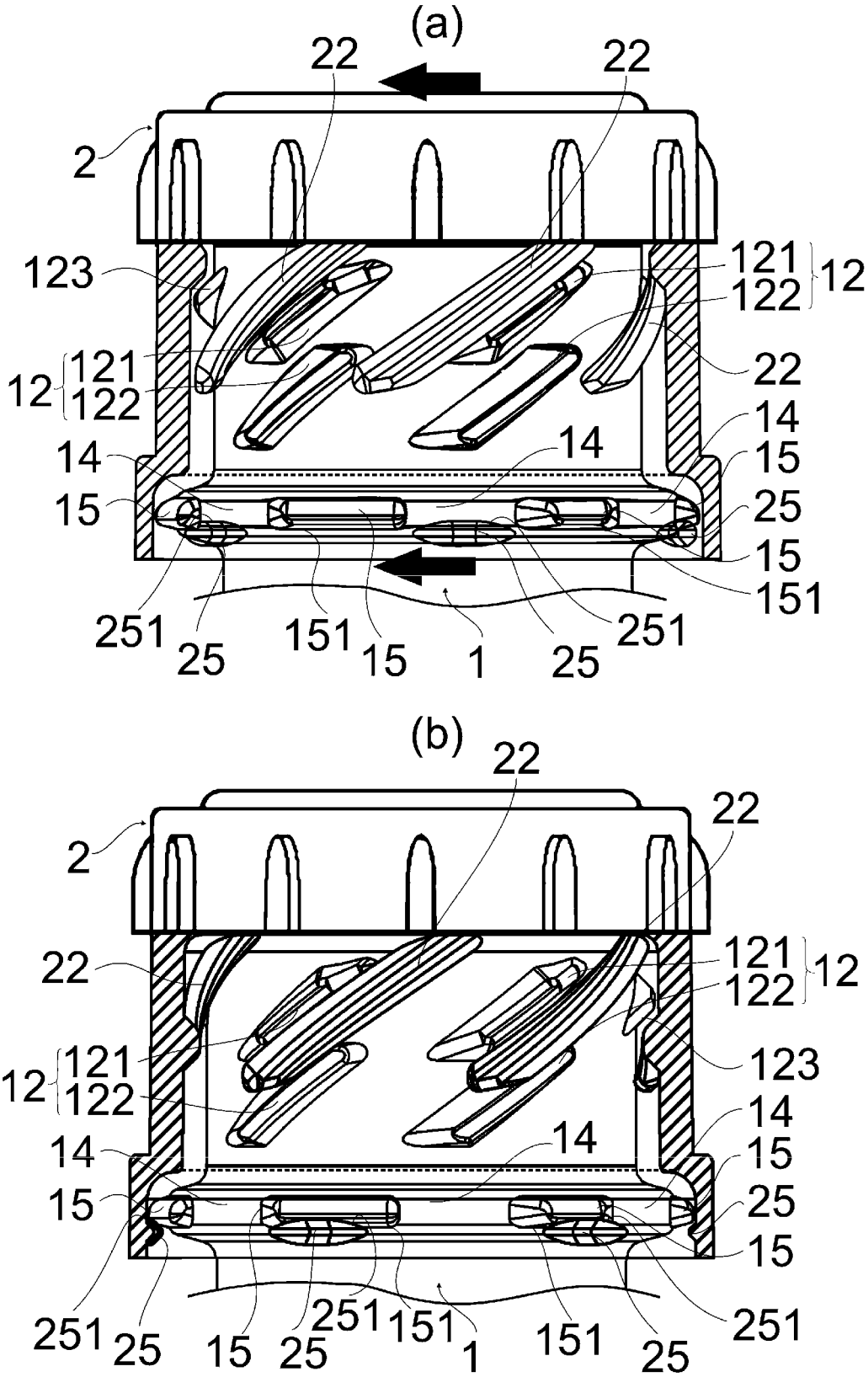
FIGS. 2(*a*) and 2(*b*) are illustrative views of the embodiment illustrated in FIGS. 1(*a*) and 1(*b*).

In the present embodiment, each of the inward multiple thread screws 221 . . . 221, which have been formed on the inner peripheral surface 21 of the cap 2 and closely clamp the upper and lower outward multiple thread screws 121 and 122 formed on the outer peripheral surface 111 of the head section 11 of the container body 1 when additionally screwing and fastening the cap 2, climbs over each of the clamped lower outward multiple thread screws 122 . . . 122 and is guided to a second fitting position closely clamped between the clamped outward multiple thread screws 121 and 122 that are vertically arranged (state illustrated in FIG. 2(*b*)).

Figure 3:
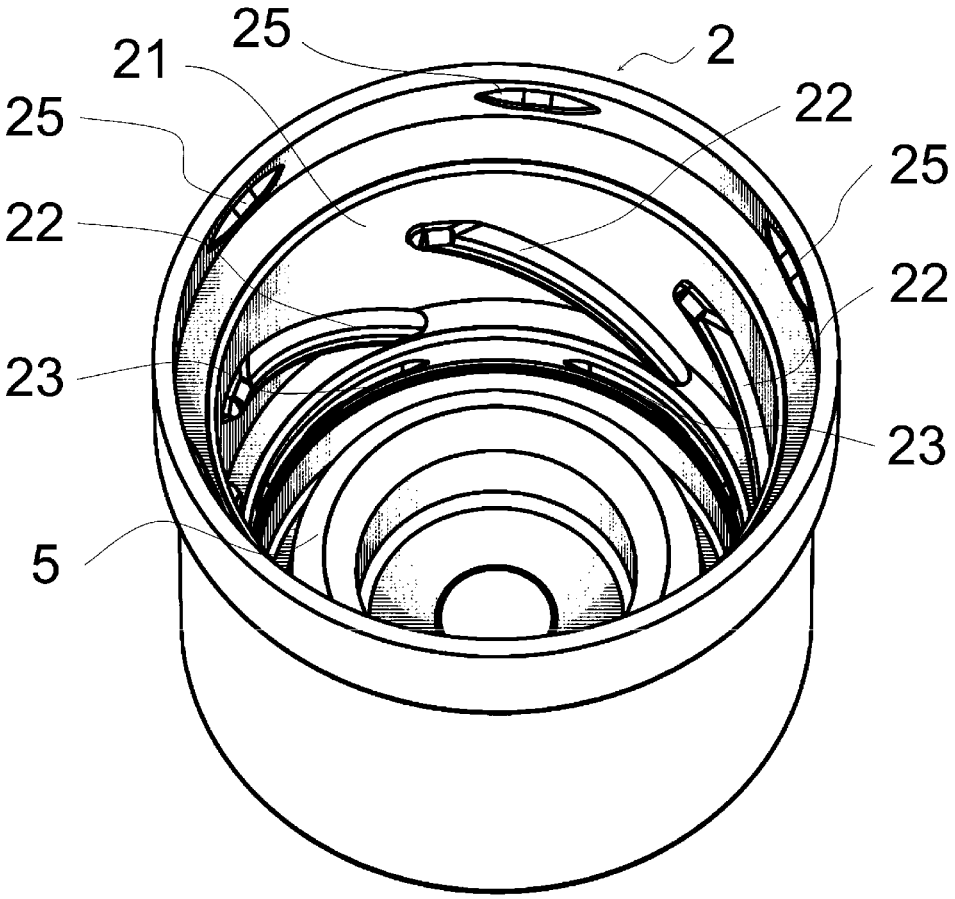
FIG. 3 is a perspective view of a cap in the embodiment illustrated in FIGS. 1(*a*) and 1(*b*).

Furthermore, in the present embodiment, a first fastening means 3 achieving a clickstop is formed, where a container body-side annular projection 13 is projected toward a top section rather than in a terminal end section of the outward multiple thread screws 121, which are outer screws 12 that have been formed on the outer peripheral surface 111 of the head section 11 of the container body 1, and a cap-side annular projection 23, which can be climbed over by the container body-side annular projection 13 and is interengaged therewith, when the cap 2 is threadedly engaged with and placed on the head section 11 of the container body 1 at the first fitting position, is projected toward a top section rather than in a terminal end of the top section side of the inner screws 22 formed on the inner peripheral surface 21 of the cap 2 (see FIG. 3).

In addition, a second fastening means 4 achieving a clickstop is included, which includes a plurality of container body-side projections 15 and a plurality of cap-side projections 25. The container body-side projections, which have a length within the range of the cap 2 when the cap 2 is placed, are projected radially each other in a circumferential direction through a predetermined gap section 14 toward a bottom section rather than in a terminal end section of each of the lower outward screws 122 which form the outer screws 12 on the outer peripheral surface 111 of the head section 11 of the container body 1, and at a predetermined distance from each other. Top surfaces 251 of the cap-side projections are arranged, through the gap section 14 of the container body-side projections 15, toward bottoms rather than on bottom surfaces 151 of the container body-side projections 15 projected on the outer peripheral surface 111 of the head section 11 of the container body 1 when the cap 2 is placed at the first fitting position on the inner peripheral surface 21 of an opening end of the cap 2, and are pressed and held overlapping each other on the bottom surfaces 151 of the container body-side projections 15, when the cap 2 is fastened, and threadedly engaged and placed at the second fitting position.

In the present embodiment, as for outer screws 12 formed on the outer peripheral surface of the head section 11 of the container body 1, six outer screws are formed, radiating at an angle of 30° from the central axis. However, two sets of those outer screws 12, opposed to each other, are formed by the pair of upper and lower outward multiple thread screws 121 and 122, and another pair of outer screws 12 and 12 opposed to each other is formed by one outward multiple thread screw 123 and 123 arranged at the same height as the upper outward multiple thread screws 121. As a result, stiffness in rotation when fastening and opening the cap 2 is adjusted, and the cap 2 can be opened and closed with a modest rotating torque.

Particularly, in the present embodiment, as for outer screws 12 formed by one outward multiple thread screw 123 and 123, when a fastening position of the cap 2 is at the time of the first fastening, a bottom surface of an inner screw 22 formed on the inner peripheral surface 21 of the cap 2 closely contacts a top surface of the outward multiple thread screw 123, and at the second fastening position, a top surface of a next inner screw 22 moving to a side adjacent to the inner screw 22 closely contacts a bottom surface of the outward multiple thread screw 123, which fits, as with the set of upper and lower outward multiple thread screws 121 and 122, into the inner screw 22 and reliably fastens the cap 2 to the container body 1.

Additionally, in the present embodiment, in a top section of the inner peripheral surface 21 of the cap 2, an inner ring 5 is formed, which abuts on an inside surface along the opening end 112 of the head section 11 of the container body 1 when the cap 2 is placed on the head section 11 of the container body 1, and clamps and supports a vicinity of the opening end 112 of the head section 11 of the container body between itself and the inside surface of the cap. Therefore, the sealing performance is also superior.

As described above, the present embodiment makes it possible to open and close the cap with less rotation basically by using multiple thread screws with a large lead angle, instead of single thread screws, as a means for fastening the cap 2 to the head section 11 of the container body 1, and is extremely efficient and appropriate for housing an object such as a specimen that needs to be stored by promptly opening and closing the cap 2.

Moreover, with the configuration where the cap 2 is fastened in two stages including the first fastening means 3 and the second fastening means 4, each of which demonstrates a click feeling with sound and touch, reliable fastening can be achieved and leakage by forgetting to close the cap 2 can be prevented.

Figure 4:
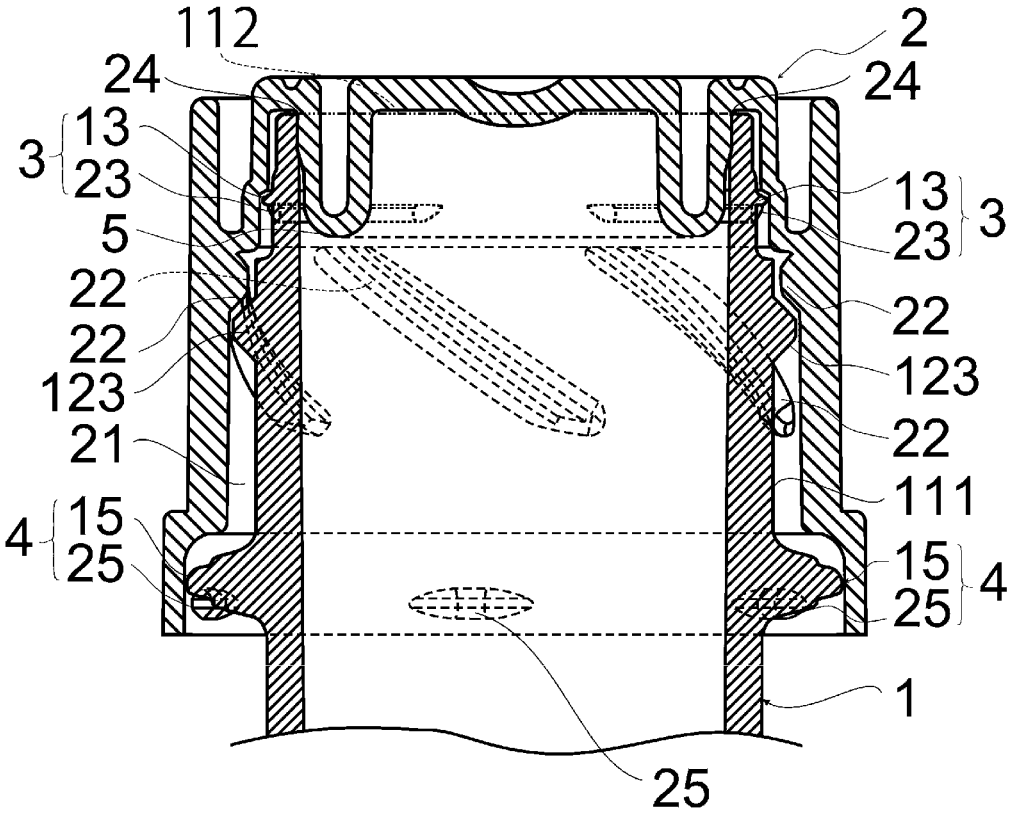
FIG. 4 is a sectional view of a usage state of a container body and the cap in the embodiment illustrated in FIGS. 1(*a*) and 1(*b*).
Figure 5:
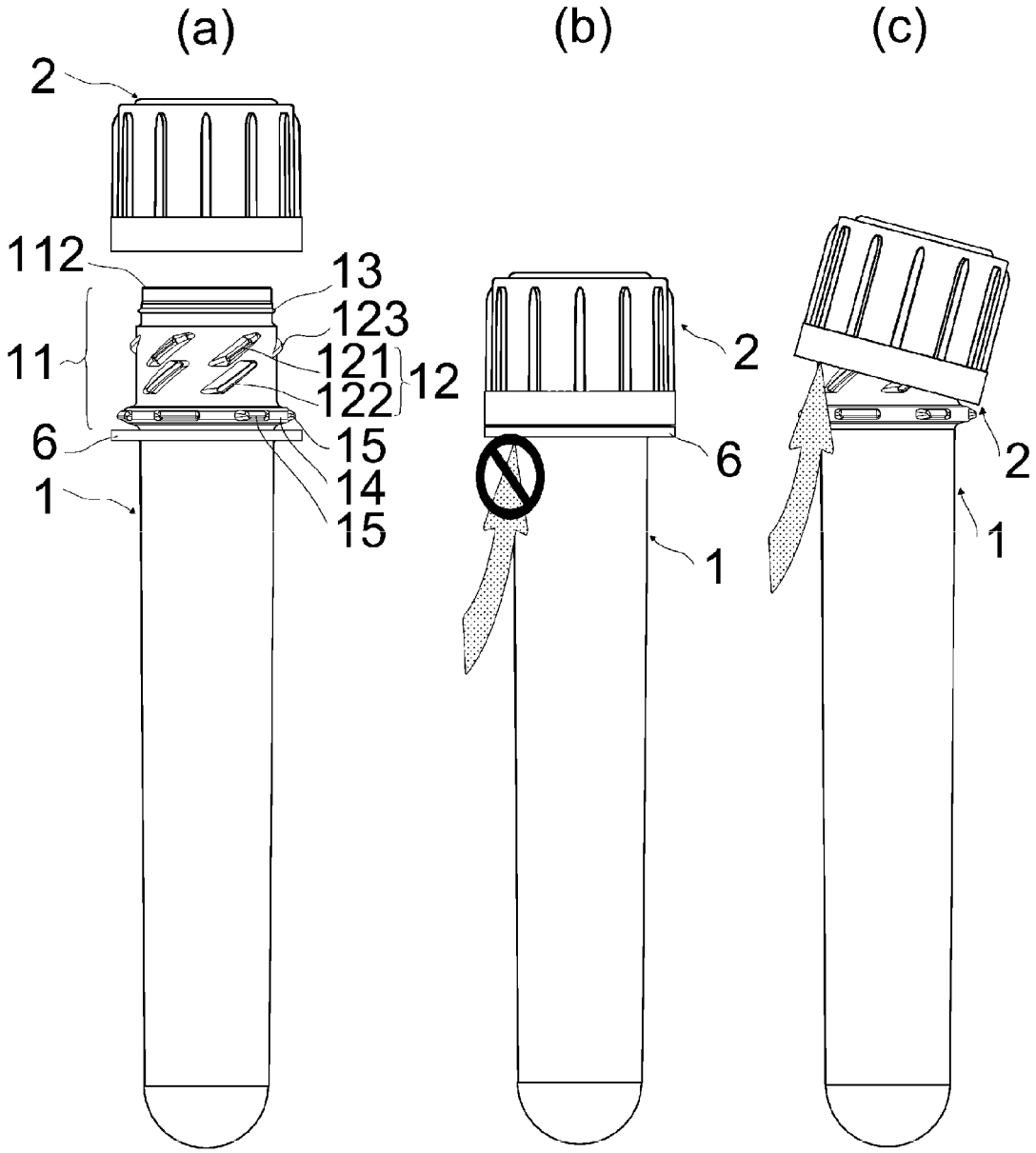
FIGS. 5(*a*) to 5(*c*) are illustrative views of a different embodiment of the present invention.
Figure 6:
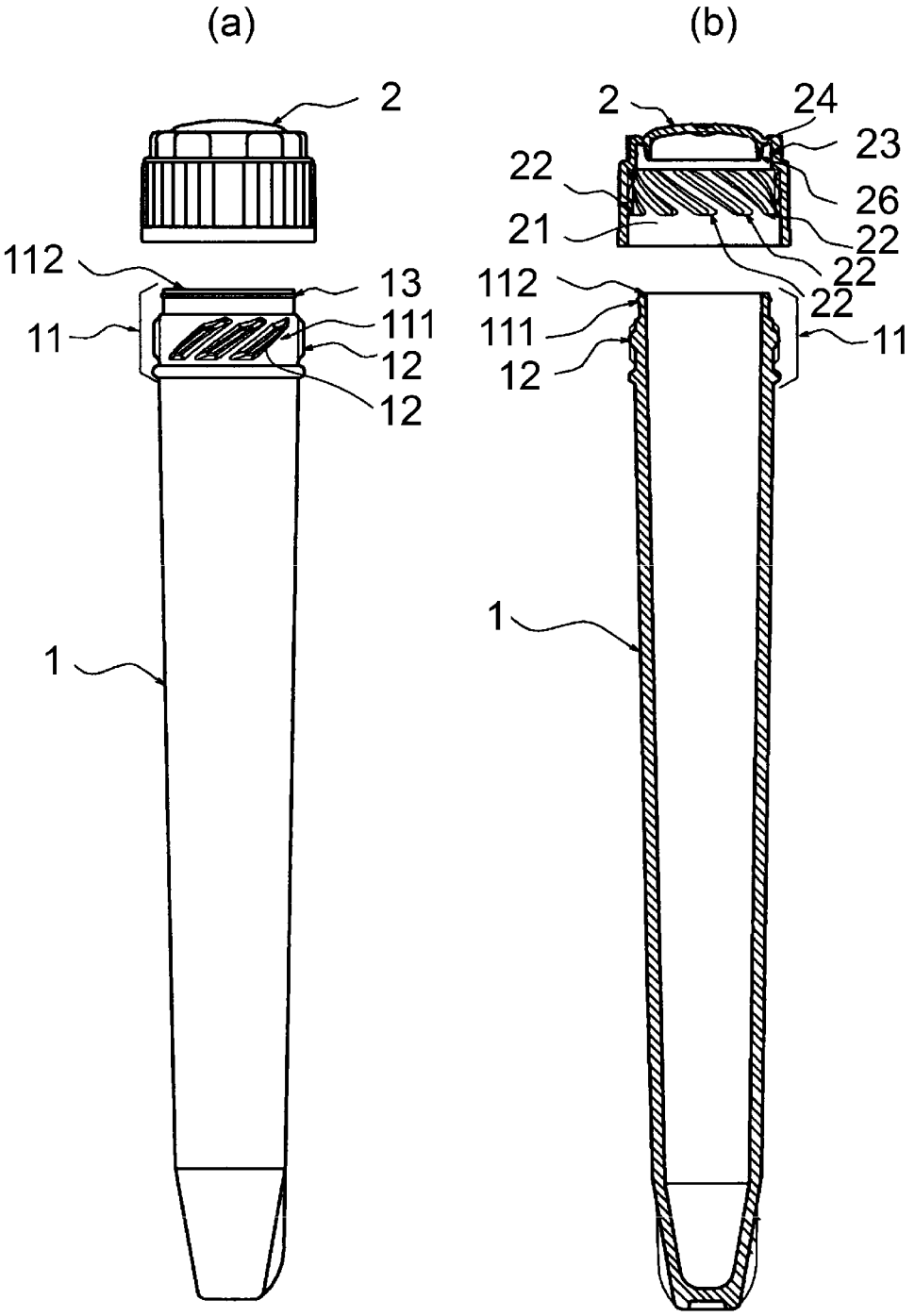
FIG.6 Prior Art
FIGS. 6(*a*) and 6(*b*) are front and sectional views of a conventional example.
Figure 7:
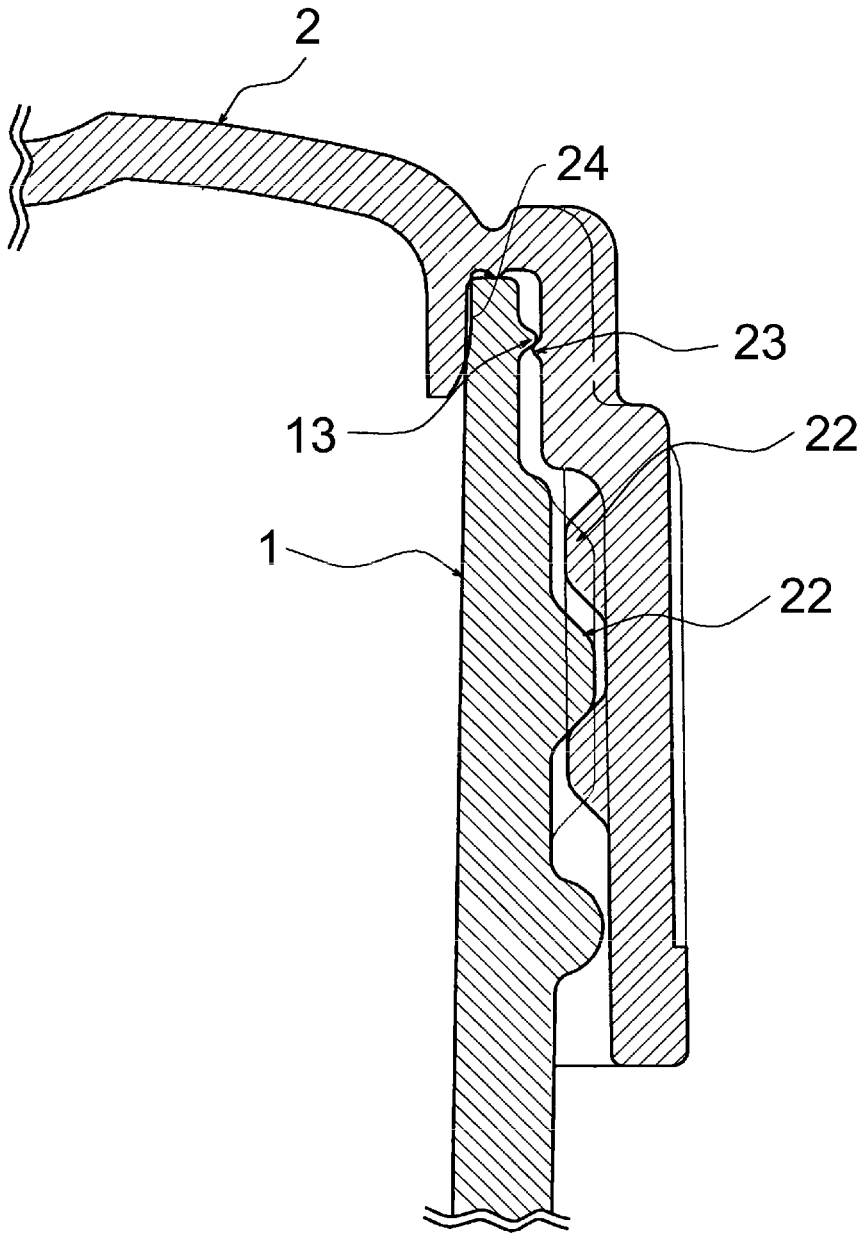
FIG.7 Prior Art
FIG. 7 is a sectional view of a usage state of a container body and a cap in the conventional example illustrated in FIGS. 6(*a*) and 6(*b*).

Furthermore, FIGS. 5(*a*) and 5(*b*) illustrate a different embodiment of the present invention. FIG. 5(*c*) illustrates the preferred embodiment of the present invention illustrated in FIGS. 1(*a*) and 1(*b*) or FIG. 4. The different embodiment of the present invention, illustrated in FIGS. 5(*a*) and 5(*b*), is that a flange 6, which has an outer shape along an edge of an opening end of the placed cap 2, is projected toward bottom surfaces of container body-side proj ections on an outer peripheral surface 111 of a container body 1. Particularly in a case, for example, where other capped containers arranged vertically vibrate vertically during transportation, for example, even when portion of the cap 2 is pushed upward by an expected large force, or even when the whole capped container is pushed upward, a force in an opening direction does not act on the cap 2. Therefore, the cap 2 can be surely prevented from opening by an impact during transportation or storage.

REFERENCE SIGNS LIST

1 Container body
2 Cap
3 First fastening means
4 Second fastening means
5 Inner ring
6 Flange
11 Head section
12 Outer screw
13 Container body-side annular projection
14 Gap section
15 Container body-side projection
21 Inner peripheral surface
22 Inner screw
23 Cap-side annular projection
24 Top inner surface
25 Cap-side projection
111 Outer peripheral surface
112 Opening end
121 Outward multiple thread screw
122 Outward multiple thread screw
123 Outward multiple thread screw
221 Inward multiple thread screw

The invention claimed is:

1. A capped container comprising:

a container body that has outer screws formed on an outer peripheral surface in a head section; and a cap that has inner screws to be threadedly engaged with the outer screws, formed on an inner peripheral surface, and is placed on the head section of the container body by screw-fitting and removed therefrom, wherein an opening end in the head section of the container body closely contacts a top inner surface of the cap when the cap is placed on the head section of the container body, the inner screws formed on the inner peripheral surface of the cap are inward multiple thread screws arranged at a predetermined distance and angle, the outer screws to be threadedly engaged with the inner screws, formed on the outer peripheral surface of the head section of the container body, are formed by upper and lower two-stage outward multiple thread screws arranged at a predetermined distance and angle in accordance with the inward multiple thread screws, the inward multiple thread screws being formed adjacent to each other on an inner surface of the cap when the cap is placed on the head section of the container body, threadedly engaged, at a clamping position, with the upper and lower outward multiple thread screws formed on an outer surface of the head section of the container body, and guided to a first fitting position, the inward multiple thread screws, which have been formed on the inner surface of the cap and closely clamp the upper and lower outward multiple thread screws formed on the outer surface of the head section of the container body when additionally screwing and fastening the cap, climb over the lower outward multiple thread screws and are guided to a second fitting position closely clamped between the upper and lower outward multiple thread screws that have been clamped, and the capped container further includes: a first fastening means including a container body-side annular projection that is projected toward a top section rather than in a terminal end section of the outer screws formed on the outer peripheral surface of the head section of the container body, and a cap-side annular projection, which is projected toward a top section rather than in a terminal end of a top section side of the inner screws formed on the inner peripheral surface of the cap, can be climbed over by the container body-side annular projection, and is interengaged therewith at the first fitting position of the container body, when threadedly engaged with and placed on the head section of the container body at the first fitting position; and a second fastening means including a plurality of container body-side projections that are projected radially each other through a predetermined gap section toward a bottom section rather than in the terminal end section of the lower outward screws on the outer peripheral surface of the head section of the container body, and at a length within the range of the cap when the cap is placed, and a plurality of cap-side projections, top surfaces of which are arranged, through a gap section of the container body-side projections, toward bottoms rather than on bottom surfaces of the container body-side projections projected on the outer peripheral surface of the head section, when the cap is placed at the first fitting position on an inner peripheral surface of an opening end of the cap, and are pressed and held overlapping each other on the bottom surfaces of the container body-side projections, when the cap is threadedly engaged with and placed on the head section of the container body at the second fitting position through the gap section.

2. The capped container according to claim 1, wherein an inner ring, which abuts on an inside surface along an opening end of a head section of a container body when a cap is placed on the head section of the container body, and clamps and supports a vicinity of the opening end section thereof between itself and the inside surface of the cap, is formed on a top inner surface of the cap.

3. The capped container according to claim 1, wherein a circular flange, which has an outer shape along an edge of an opening end of the cap placed, is projected toward a bottom surface of container body-side projections on an outer periphery of the container body.

4. A capped container comprising:

a container body that has outer screws formed on an outer peripheral surface in a head section; and a cap that has inner screws to be threadedly engaged with the outer screws, formed on an inner peripheral surface, and is placed on the head section of the container body by screw-fitting and removed therefrom, wherein an opening end in the head section of the container body closely contacts a top inner surface of the cap when the cap is placed on the head section of the container body, the inner screws formed on the inner peripheral surface of the cap are inward multiple thread screws arranged at a predetermined distance and angle, the outer screws to be threadedly engaged with the inner screws, formed on the outer peripheral surface of the head section of the container body, are formed by upper and lower two-stage outward multiple thread screws arranged at a predetermined distance and angle in accordance with the inward multiple thread screws, the inward multiple thread screws being formed adjacent to each other on an inner surface of the cap when the cap is placed on the head section of the container body, threadedly engaged, at a clamping position, with the upper and lower outward multiple thread screws formed on an outer surface of the head section of the container body, and guided to a first fitting position, the inward multiple thread screws, which have been formed on the inner surface of the cap and closely clamp the upper and lower outward multiple thread screws formed on the outer surface of the head section of the container body when additionally screwing and fastening the cap, climb over the lower outward multiple thread screws and are guided to a second fitting position closely clamped between the upper and lower outward multiple thread screws that have been clamped.

5. The capped container according to claim 4, wherein an inner ring, which abuts on an inside surface along an opening end of a head section of a container body when a cap is placed on the head section of the container body, and clamps and supports a vicinity of the opening end section thereof between itself and the inside surface of the cap, is formed on a top inner surface of the cap.

6. The capped container according to claim 4, wherein a circular flange, which has an outer shape along an edge of an opening end of the cap placed, is projected toward a bottom surface of container body-side projections on an outer periphery of the container body.

* * * * *